US006463971B1

(12) United States Patent
Kinsey

(10) Patent No.: US 6,463,971 B1
(45) Date of Patent: Oct. 15, 2002

(54) COMBINED TOWEL AND PUTTER HEADCOVER

(75) Inventor: James M. Kinsey, Fort Wayne, IN (US)

(73) Assignee: J M Kinsey Enterprises Corp., Fort Wayne, IN (US)

( * ) Notice: Subject to any disclaimer, the term of this patent is extended or adjusted under 35 U.S.C. 154(b) by 0 days.

(21) Appl. No.: 09/903,027

(22) Filed: Jul. 11, 2001

(51) Int. Cl.[7] ..... B65D 65/02
(52) U.S. Cl. ..... 150/160; 15/209.1
(58) Field of Search ..... 150/160; D6/608; 15/209.1

(56) References Cited

U.S. PATENT DOCUMENTS

| | | | | | |
|---|---|---|---|---|---|
| 2,968,825 | A | * | 1/1961 | Wetherby | 15/118 |
| 3,831,652 | A | | 8/1974 | Hyden et al. | |
| 3,938,570 | A | | 2/1976 | Stewart | |
| 4,224,712 | A | * | 9/1980 | Black et al. | 15/209.1 |
| 4,403,366 | A | * | 9/1983 | Lucke | 15/209.1 |
| 4,771,502 | A | * | 9/1988 | Trimble | 150/160 |
| D317,693 | S | * | 6/1991 | Jencks et al. | D6/608 X |
| 5,099,897 | A | | 3/1992 | Curtin | |
| 5,146,968 | A | | 9/1992 | Meek | |
| D330,140 | S | * | 10/1992 | Lerner | D6/608 |
| 5,297,603 | A | | 3/1994 | Meek | |
| D347,542 | S | * | 6/1994 | Sheppard, Jr. | D6/608 |
| 5,322,105 | A | | 6/1994 | Meek | |
| 5,372,414 | A | * | 12/1994 | Lamonakis et al. | 150/154 |
| 5,394,914 | A | | 3/1995 | Meek | |
| D382,756 | S | * | 8/1997 | Ryan | D6/596 |
| D384,717 | S | * | 10/1997 | Hodges | D6/608 X |
| 5,769,141 | A | | 6/1998 | Rinehard | |
| 5,898,968 | A | * | 5/1999 | Beattie | 150/160 X |
| 5,918,341 | A | * | 7/1999 | Hale | 15/209.1 |
| D428,751 | S | * | 8/2000 | Edwards et al. | D6/608 |

* cited by examiner

*Primary Examiner*—Lee Young
*Assistant Examiner*—Tri M. Mai
(74) *Attorney, Agent, or Firm*—Marshall, Gerstein & Borun.

(57) ABSTRACT

A golf towel is disclosed that also functions as a putter headcover. The dual-purpose product is formed from a panel of soft, absorbent toweling that is normally folded along at least one longitudinal fold line, and preferably along two such fold lines. It has an external side pocket at its upper end into which the head of a putter may be easily inserted. The towel/headcover protects the head of the putter as it is being carried in a golf bag, and the putter in turn provides the means for supporting the towel externally of the bag where it is readily available for use in cleaning balls and clubs and for transport to a green where the towel may then be used for ball cleaning prior to putting.

10 Claims, 2 Drawing Sheets

FIG. 6
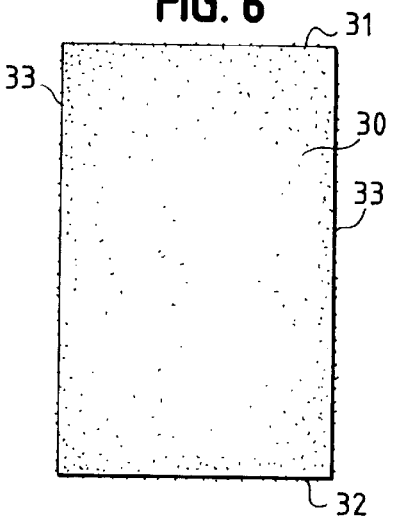
FIG. 7
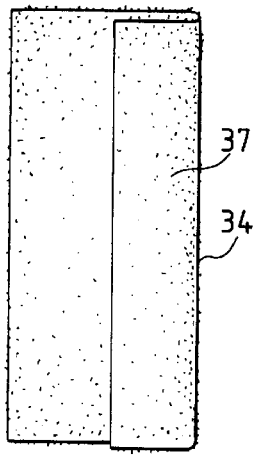
FIG. 8
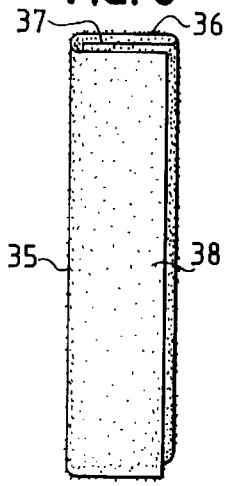
FIG. 9
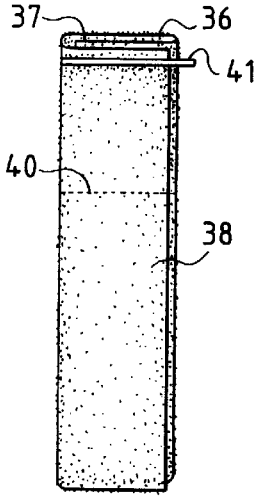
FIG. 10
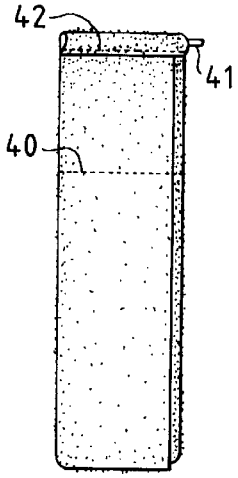
FIG, 11
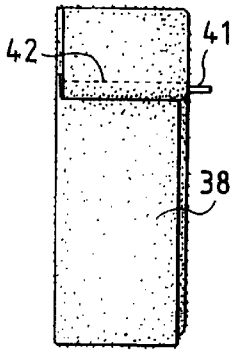
FIG. 12
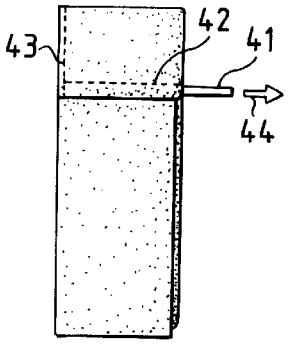
FIG. 13
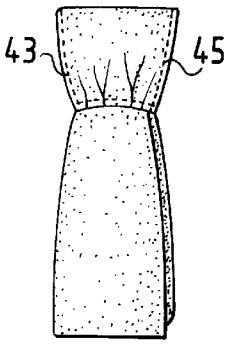

COMBINED TOWEL AND PUTTER HEADCOVER

BACKGROUND OF THE INVENTION

Material costs of and greater precision in club manufacture, along with technological improvements, have all contributed to the increased costs in recent years of quality golf clubs. Such increases have been particularly notable for so-called "high tech" putters with their milled faces and special alloys which, at least in some instances, are significantly softer than the metals used for other clubs carried in the same bags. Manufacturers of the newer putters sometimes supply them with covers to protect their faces from scratches and nicks, but it has been observed that many golfers strongly resist removing and replacing headcovers for putters each time such clubs are used.

Golfers often find the need to use towels to clean their golf balls when they arrive at the greens. Such a need, considered in combination with the desirability of protecting expensive putters against scratches and other damage, might suggest that the two functions could be combined into a towel that also serves as a headcover. While combination towel/headcover products have been known in the past, it is believed that the need for a satisfactory dual-purpose product has not been adequately met by the prior art.

In general, it is believed that dual-purpose products have had one or more notable shortcomings, including relatively expensive construction that is not well suited for frequent laundering and rugged use, inadequate size for functioning effectively as a towel and, in particular, design features that render such product awkward and even inconvenient to use. For examples of the prior art, reference may be had to U.S. Pat. Nos. 3,831,652, 5,146,968, 5,769,141, 5,394,914, 3,938,570, 5,297,603, and 5,322,105.

SUMMARY OF THE INVENTION

One aspect of this invention lies in providing a combination towel/headcover that is relatively easy to use, keeping in mind just how such a product would be likely to be handled in actual use. A golfer requiring the use of a towel to clean his/her ball prior to putting would be expected to drop the towel on the green after ball cleaning and prior to putting. The combination towel/headcover of this invention may be easily picked up after putting is completed simply by hooking the head of a putter into an external side pocket at the towels' upper end. The same pocket receives and protects the head of the putter while that club is carried in a golf bag, with the towel/headcover being supported by the putter in such a way that its towel portion drapes downwardly along the bag's outer surface. Subsequent removal of the towel/headcover from the putter is easily accomplished without requiring the manipulation of zippers, hook-loop (Velcro-type) fasteners, or other fastening means. Because of its folded construction, which involves at least two and preferably three folded sections, the towel portion provides relatively large surface areas for ball and club cleaning. Further, because the towel/headcover is formed entirely of soft, absorbent toweling material, it is relatively inexpensive in construction and well suited for conventional laundering.

Briefly, the towel/headcover combination of this invention takes the form of a generally rectangular panel of soft, absorbent fabric having top, bottom, and side edges and being folded along at least one longitudinal fold line to provide two, and preferably three, folded sections of fabric. Those sections are secured together along the top edge of the panel.

The headcover/towel combination includes both a towel portion and an integral headcover portion. The headcover portion essentially comprises a flap composed of the upper portions of the superimposed sections together folded downwardly about a transverse fold line to define a downwardly-facing side pocket. The towel portion comprises the folded panel sections extending downwardly below the entrance to the pocket, with the towel portion constituting the major length of the absorbent panel and being unfoldable in use for purposes of ball and club cleaning.

The side margins of the pocket are closed by stitching, sewing, or any other suitable means. The mouth of the pocket formed by the downwardly-folded flap is preferably elasticized so that it puckers into partially-open condition to facilitate the insertion of the tip of a putter, and the lifting of the towel/headcover from a ground surface, when the product is in use.

Other features, advantages, and objects of the invention will become apparent from the specification and drawings.

DRAWINGS

FIG. 6 is a plan view of a fabric panel serving as a blank for forming the towel/headcover combination of this invention.

FIGS. 7–13 illustrate the sequence of folding and sewing steps involved in fabricating a completed towel/headcover combination.

DETAILED DESCRIPTION OF PREFERRED EMBODIMENT

Figure 1:
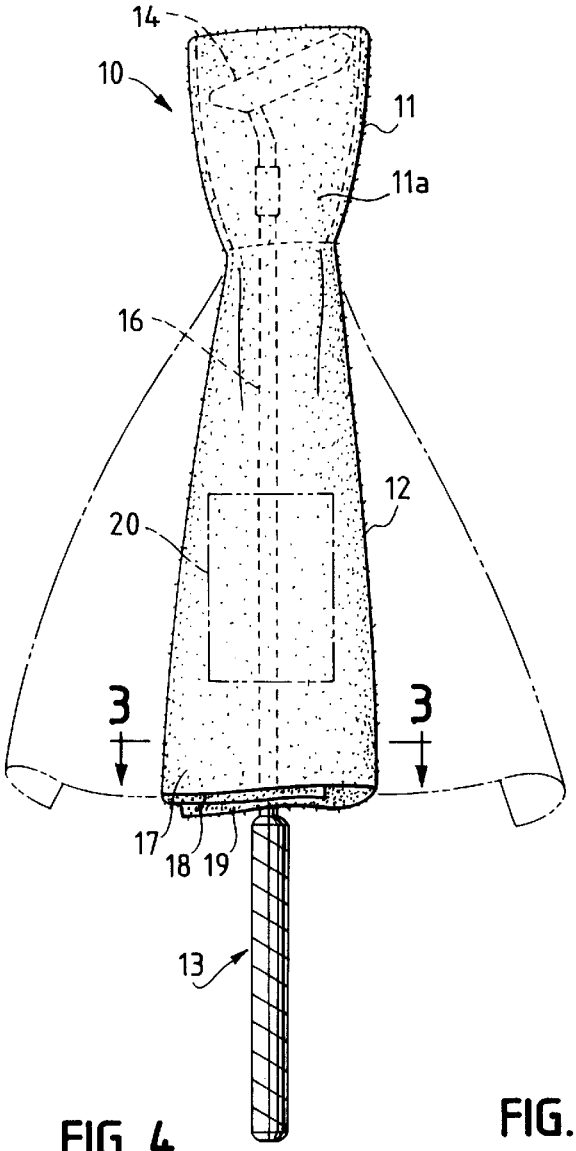
FIG. 1 is an elevational view showing the front side of a combination towel/headcover embodying the present invention.

Referring to the drawings, the numeral 10 general designates a combination towel and headcover formed entirely from a single panel of soft, absorbent fabric such as cotton toweling. The product has two main portions, namely, an upper headcover portion 11 and a lower towel portion 12. When the product is fitted upon and supported by a putter 13 in the manner shown in FIGS. 1–4, the head 14 of the putter is received in a downwardly-facing pocket 15 of the headcover portion 11, and the towel portion is disposed entirely to one side of the shaft 16 of the putter. It will be noted that the towel portion 12 drapes downwardly alongside the shaft in a plurality of loosely folded sections. Three such sections 17, 18, and 19 are preferred because of the large surfaces provided when the towel portion is unfolded as indicated in phantom in FIG. 1; however, some of the benefits of the invention might be achieved to a lesser extent if only two such folded sections are provided.

Figure 4:
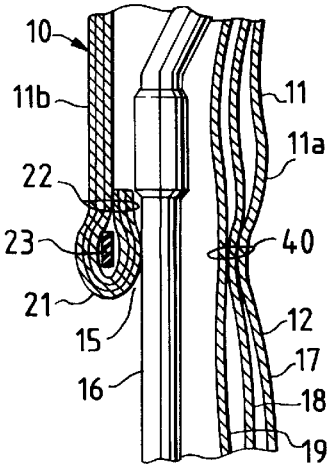
FIG. 4 is a fragmentary longitudinal sectional view taken along line 4—4 of FIG. 2.
Figure 3:
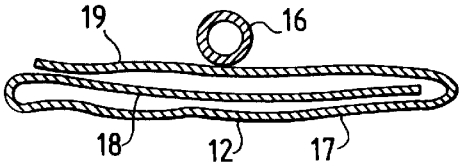
FIG. 3 is a cross sectional view taken along line 3—3 of FIG. 1.

As depicted most clearly in FIG. 4, the front wall 11*a* and back wall 11*b* of headcover portion 11 are each formed of multiple thicknesses of fabric. Three such thicknesses are shown and are preferred because of the cushioning and greater protection afforded by triple thicknesses of fabric. Again, however, double thicknesses for each of the walls might suffice although they would afford less protection and cushioning for a putter head and are therefore considered less beneficial than triple thicknesses of material.

Dimensions may vary considerably, depending partly on the size of the putter head to be received in pocket 15. In general, the headcover portion 11 should a width of approximately 5 to 8 inches and a height (when viewed as in FIGS. 1 and 2) of approximately 5 to 8 inches, with 6 inches for both dimensions being considered preferable in most instances. The towel portion 12 should have a vertical length (i.e., a length extending along the shaft of the club) of approximately 12 to 18 inches, with a length of about 17 inches being considered optimum. The width of each of the sections 17–19 of the towel portion is essentially the same as the width of the headcover portion 11, or about 5 to 8 inches with 6 inches being preferred. The result is a towel portion which may be unfolded or spread to a width ranging between 15 to 24 inches. It should be understood that such a range of unfolded widths encompasses towel portions that have double folds resulting in three sections of material, and that if only a single fold and two such thicknesses were provided, the unfolded width of the towel portion would be reduced accordingly. In any event, the substantial length and width of the towel portion affords large surface areas for ball and club cleaning. Furthermore, the substantial length and width of that section of the towel portion that faces forwardly, and is therefore exposed along the outside of a golf bag when the headcover portion 11 is fitted over the head of a putter carried in the bag, offers a large surface area for suitable indicia such as, for example, a club logo, brand name, or the like. The possible location for such indicia is indicated by phantom line 20 in FIG. 1.

Figure 2:
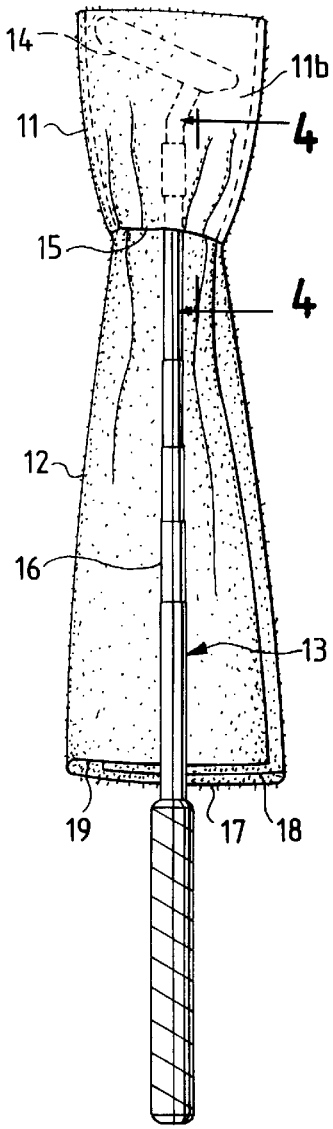
FIG. 2 is an elevational view showing the backside of the combination towel/headcover.
Figure 5:
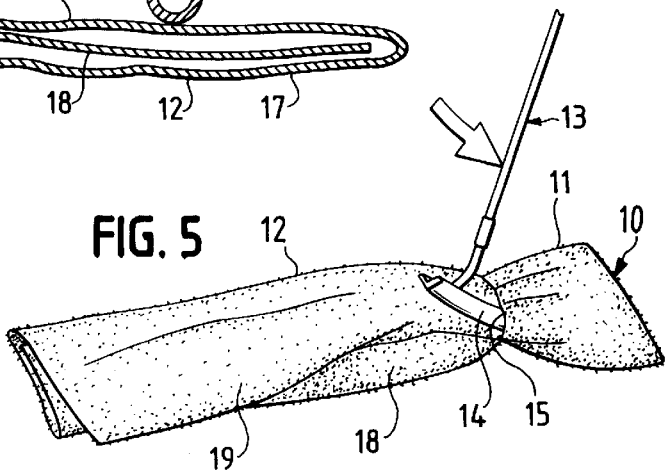
FIG. 5 is a perspective view illustrating how the towel/headcover may be hooked and lifted from a ground surface by means of a putter.

Referring to FIG. 4, it will be seen that the lower edge of back wall 11*b* of the headcover portion 11 defines the mouth 21 of the inverted pocket 15. The edge may be hemmed and stitched as represented by numeral 22 and is preferably elasticized as indicated by elastic band 23. In the finished product, the elastic band is stretched and under tension, causing the mouth of the pocket to pucker as illustrated in FIGS. 2 and 5. Such puckering causes the mouth to assume a partially open condition, so that when the towel is resting upon a ground surface, such as the surface of a putting green, a player needs only to hook the tip of his/her putter into the pocket to catch and lift the towel as indicated in FIG. 5. Such advantages are achieved largely because the side pocket is an external one and is exposed for receiving the tip of a putter as shown. After the combination headcover/towel has been lifted from a putting surface, it is a simple matter for a player to complete the insertion procedure, thereby fully protecting the head of the putter from damage as the club is placed into and carried in a golf bag.

FIGS. 6–13 illustrate the sequence of steps involved in making the preferred embodiment FIGS. 1–5. The starting material is a panel or blank 30 of soft, absorbent fabric such as cotton toweling. The panel is generally rectangular in shape, having top bottom and side edges 31–33 and preferably has a vertical length (measured along longitudinal sides edges 33) greater than its width. The panel is then folded along a first longitudinal fold line 34, and preferably along a second longitudinal fold line 35 to provide three longitudinally-folded sections 36, 37 and 38 of approximately equal size (FIGS. 7, 8). In the preferred construction shown, sections 37 and 38 constitute side sections and 36 is a central section; however, if desired, section 38 (or 37) may be reversely folded so that when viewed from the end of the panel the folds form a generally "S" shape. Also, as already explained, the folding may occur along only a single fold line with only two overlapping sections, although such a construction is considered less desirable. In any event, the rectangular panel 30 must be folded along at least one longitudinal fold line, and preferably two lines, to provide at least two and preferably three thicknesses of folded fabric.

In FIG. 9, the folded panel 30 has its folded sections secured together by a transverse line of stitching 40. That line of stitching is considered highly desirable because it improves the integrity of the product and helps delineate the headcover and towel portions of the finished product. In particular, it keeps towel sections 17–19 together adjacent the opening of pocket 15, thereby insuring that the head of a putter will enter the external side pocket and not become mislocated between layers 17–19.

At the upper end of the panel 30, sections 36–38 are stitched together after enclosing or being wrapped about an elastic band 41. An upper flap portion is then folded downwardly along a transverse fold line to form the start of a downwardly facing pocket, so that what was previously the upper edge of the panel is brought into general alignment with transverse stitching 40 (FIG. 11). One side of the pocket is closed by a line of stitching 43, the exposed end of elastic band 41 is then pulled outwardly in the direction of arrow 44 to tension the band, and a final line of stitching 45 is applied to the opposite margin of the pocket to complete closing of the sides of the pocket and to lock the tensioned band in stretched condition. The stub of the band 41 is then removed, producing the finished product depicted in FIG. 13.

While in the foregoing, an embodiment of the invention has been disclosed in considerable detail for purposes of illustration, it will be understood by those skilled in the art that many of these details may be varied without departing from the spirit and scope of the invention.

What is claimed is:

1. A headcover and towel combination, comprising a generally rectangularly panel of soft, absorbent fabric having top, bottom and side edges and being folded along at least one longitudinal fold line to provide plural thicknesses of fabric including front and back sections; said plural thicknesses of fabric being secured together along said top edge of said panel; said headcover and towel combination including a headcover portion and a towel portion; said headcover portion comprising a flap composed of said plural thicknesses of fabric adjacent said top edge having been folded downwardly to define a downwardly-facing external side pocket; said towel portion comprising said plural thicknesses of fabric of said panel extending downwardly a substantial distance below said side pocket with said sections of said towel portion being unfoldable for purposes of ball and club cleaning; said plural thicknesses of fabric of said headcover portion being secured together along longitudinal side edges of said headcover portion to close the sides of said downwardly-facing pocket.

2. The headcover and towel combination of claim 1 in which said plural thicknesses of fabric that are secured together along said top edge of said panel, and are then folded downwardly to provide the lower edge of said flap, are elasticized to cause puckering of said lower edge of said flap resulting in a pocket having a partially open mouth.

3. The headcover and towel combination of claims 1 or 2 in which said headcover portion and said towel portion are generally flat; said headcover portion having a width and length of approximately 5 to 8 inches each, and said towel portion having a length of approximately 12 to 18 inches.

4. The headcover and towel combination of claim 3 in which said headcover portion has a width and length of approximately 6 inches each, and said towel portion has a length of approximately 17 inches.

5. The headcover and towel combination of claim 1 in which said plural thicknesses of fabric of said towel portion are secured together along a transverse line of attachment at the upper end of said towel portion.

6. A putter headcover and towel combination comprising a generally rectangular panel of soft, absorbent fabric having top, bottom and side edges and being folded along two longitudinally extending fold lines to provide three thickness of fabric including a center section and a pair of side sections; said three thicknesses of fabric being secured together along said top edge of said panel; said combination including a headcover portion and a towel portion; said headcover portion comprising a flap of said three thicknesses of fabric folded downwardly from the top edge of said panel to define a downwardly-facing external side pocket for receiving the head of a putter; said headcover portion being generally flat and including front and back walls secured together along opposite side margins of said pocket with each of said front and back walls being composed of three thicknesses of said fabric; said towel portion comprising said three thicknesses of said panel extending downwardly below said pocket with said side sections of said towel portion being unfoldable from said center section to expand said towel portion for ball and club cleaning.

7. The putter headcover and towel combination of claim 6 in which said three thicknesses of fabric that are secured together along said top edge of said panel, and are then folded downwardly to provide the lower edge of said flap, are elasticized to cause puckering of said lower edge of said flap resulting in a pocket having a partially open mouth.

8. The putter headcover and towel combination of claim 6 in which said headcover portion and said towel portion are generally flat; said headcover portion having a width and length of approximately 5 to 8 inches each, and said towel portion having a length of approximately 12 to 18 inches.

9. The putter headcover and towel combination of claim 8 in which said headover portion has a width and length of approximately 6 inches each, and said towel portion has a length of approximately 17 inches.

10. The putter headcover and towel combination of claim 7 in which said three thicknesses of fabric of said towel portion are secured together along a transverse line of attachment adjacent to the mouth of said external side pocket.

* * * * *